US006005213A

United States Patent [19]

Morita et al.

[11] Patent Number: 6,005,213

[45] Date of Patent: Dec. 21, 1999

[54] INSULATED TYPE SWITCHGEAR DEVICE

[75] Inventors: Ayumu Morita; Takashi Sato, both of Hitachi; Youichi Ohshita, Hitachinaka; Tooru Tanimizu; Masayoshi Hayakawa, both of Hitachi; Toshio Horikoshi, Fujioka; Ryutaro Yamamoto, Tokyo, all of Japan

[73] Assignees: Hitachi, Ltd.; The Tokyo Electric Power Co., Ltd., both of Tokyo, Japan

[21] Appl. No.: 09/028,640

[22] Filed: Feb. 24, 1998

[30] Foreign Application Priority Data

Mar. 6, 1997 [JP] Japan ..... 9-051705

[51] Int. Cl.[6] ..... H01H 33/66

[52] U.S. Cl. ..... 218/124; 218/118; 218/140

[58] Field of Search ..... 218/118, 120, 218/123, 124, 134, 139, 135, 140, 142, 146, 154, 155

[56] References Cited

U.S. PATENT DOCUMENTS

| | | | |
|---|---|---|---|
| 3,591,743 | 7/1971 | Ramheim | 218/140 |
| 5,387,772 | 2/1995 | Bestel | 218/134 |
| 5,719,365 | 2/1998 | Tanimzu et al. | 218/118 |

FOREIGN PATENT DOCUMENTS

| | | |
|---|---|---|
| 55-143727 | 11/1980 | Japan . |
| 3-273804 | 12/1991 | Japan . |

*Primary Examiner*—Lincoln Donovan
*Attorney, Agent, or Firm*—Beall Law Offices

[57] ABSTRACT

In an insulated type switchgear device in which a pair of arc electrodes are separably disposed in an opposing manner in a vacuum tube, and having a movable conductor extending from a back face of a movable one of the arc electrodes to the outside of the vacuum tube, the pair of arc electrodes are designed to be separated through a rotation of the movable conductor around a predetermined main axis. The movable arc electrode is structured in such a manner that an electrode center of the movable arc electrode, when the movable arc electrode is brought into its circuit breaking position, is to be located near a center axis of the stationary arc electrode, whereby the center of the movable arc electrode is offset from the center axis of the stationary arc electrode when the pair of arc electrodes are brought into their circuit making position, and whereby an insulation type switchgear device is provided which suppresses a possible offsetting of arc electrodes at a circuit breaking position thereof, improves circuit breaking performance thereof, and permits downsizing thereof.

28 Claims, 10 Drawing Sheets

INSULATED TYPE SWITCHGEAR DEVICE

BACKGROUND OF THE INVENTION

1. Field of the Invention

The present invention relates to an improvement in an insulated type switchgear device, and more specifically, to an improvement in a vacuum type switchgear with multi-functions in which a pair of arc electrodes are designed to be separable through rotation of a movable conductor around a predetermined main axis.

2. Related Art

A commonly used transformer substation includes such components as transformers, circuit breakers and disconnecting switches, and an electric power from the transformers is supplied via the circuit breakers and disconnecting switches to loads such as motors. When performing maintenance and inspection of the loads, these circuit breakers as well as the disconnecting switches which are provided separately from these circuit breakers are opened, and further, by means of a grounding device remanent electric charges and inductive currents at a power source side are sinked into a ground so as to ensure safety of maintenance persons.

In these switchgear devices, for example, in a vacuum circuit breaker, circuit making and breaking operations are performed by engaging and disengaging a pair of arc electrodes which are disposed in a vacuum tube.

In general, a vacuum circuit breaker having a structure in which a movable conductor is moved with respect to a stationary conductor in a vertical direction by means of an operating mechanism disposed outside the vacuum tube so as to engage and disengage the pair of arc electrodes, each provided at one end of the respective movable and stationary conductors, is frequently employed.

Further, a vacuum circuit breaker as disclosed, for example, in JP-A-55-143727(1980), in which a movable arc electrode is designed to engage and disengage with a stationary arc electrode through rotation of the movable arc electrode around a predetermined main axis, is also used.

Generally, in a circuit breaker, when an arc stays at a portion between the arc electrodes during a circuit breaking operation, the surface temperature of the arc electrodes increases due to thermal input from the arcing to thereby cause melting of the metal of the arc electrodes. In such an instance, consumption of the arc electrodes is significant as well as surplus vapour metal particles existing between arc electrodes extremely reduces its circuit breaking performance. Therefore, in vacuum circuit breakers and in particular those for interrupting a large current, a variety of measures are applied for the structure of the arc electrodes.

For example, with spiral electrodes in which spiral ditches are provided for the arc electrodes, an arc is provided with a driving force in a rotating direction by a current flowing through the arc electrodes and is always moved between the arc electrodes to thereby suppress the melting of metal on the surface of the arc electrodes.

Further, with coil shaped electrodes provided at the back faces of the arc electrodes, magnetic flux in the axial direction of the arc electrodes is generated to thereby diffuse the arc uniformly between the arc electrodes and to reduce current density of the arc.

However, conventional insulated type switchgear devices contain the following problems. Namely, in the conventional insulated type switchgear devices as disclosed, for example, in JP-A-3-273804(1991), circuit breakers, disconnecting switches and grounding switches therefor are separately manufactured and installed, therefore, the size of the device is increased. Further, with the circuit breaker making use of a rotating movement operation in which the engagement and disengagement with the stationary arc electrode is performed through rotation of the movable arc electrode around a predetermined axis, the pair of arc electrodes are placed in an offset position when performing a circuit breaking operation. Therefore, a region which allows an arc ignition (in other words the effective area of the arc electrodes) decreases, and thereby the circuit breaking performance thereof is likely reduced.

SUMMARY OF THE INVENTION

The present invention is carried out in view of the above problems, and an object of the present invention is to provide an insulated type switchgear device like the similar types explained above, in which the offsetting of a pair of arc electrodes during the circuit breaking operation is suppressed to improve the circuit breaking performance thereof, and in which the size thereof is reduced.

Namely, the above object of the present invention is achieved by an insulated type switchgear device having a pair of arc electrodes that are separably disposed in an opposing manner in a vacuum tube, a movable conductor extending from a back face of one of the arc electrodes. One of the arc electrodes is a movable arc electrode connected to the movable conductor and to the outside of the vacuum tube. The pair of arc electrodes are designed to be separated through a rotation of the movable conductor around a predetermined main axis, wherein the movable arc electrode is structured in such a manner that an electrode center of the movable arc electrode when the movable arc electrode is brought into its circuit breaking position is to be located near a center axis of the other arc electrode, which is a stationary arc electrode, whereby the center of the movable arc electrode is offset from the center axis of the stationary arc electrode when the pair of arc electrodes are brought into their circuit making position.

Further, the pair of arc electrodes are structured in such a manner that an angle formed by the facing surfaces of the pair of arc electrodes when the movable arc electrode is brought into its circuit breaking position is designed to be less than 20°.

Still further, the movable conductor is configurated in an L shape and a distance from the movable arc electrode to a bent portion of the L shaped movable conductor is selected to be longer than 30% of a diameter of the movable arc electrode.

Moreover, in the insulated type switchgear device a grounding conductor is further disposed in the vacuum tube, and through the rotation of the movable conductor at least one of opening and closing between the pair of arc electrodes and between the movable conductor and the grounding conductor is effected.

Further, in the insulated type switchgear device the stationary and movable arc electrodes are respectively provided with a ditch for magnetically driving an arc generated therebetween.

Namely, with the thus structured insulated type switchgear device, one of the arc electrodes is disposed in advance in an offset relation with respect to the other arc electrode at their circuit making position, therefore, a possible offsetting of the pair of arc electrodes during a circuit breaking operation is reduced so that, because of the reduced offsetting, the circuit breaking performance thereof is improved.

DESCRIPTION OF EMBODIMENTS OF THE INVENTION

Hereinbelow, the present invention is explained in detail with reference to the embodiments illustrated.

Figure 1:
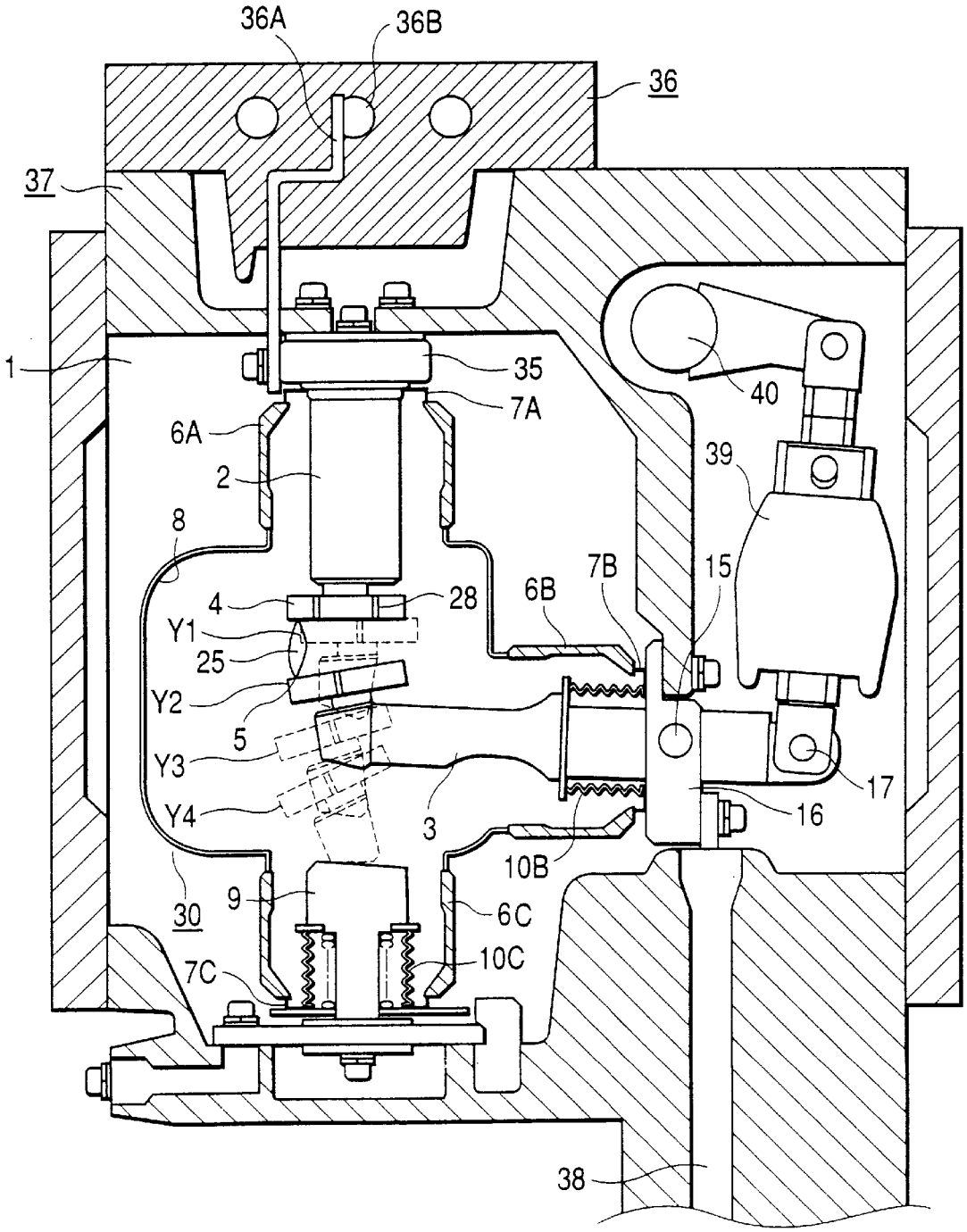
FIG. 1 is a vertical side cross sectional view showing one embodiment of an insulated type switchgear device according to the present invention.

FIG. 1 shows a cross sectional view of an insulated type switchgear device. A vacuum tube 30 is disposed inside an insulation gas container 37. Namely, inside the insulation gas container 37 formed by molding epoxy resin the vacuum tube 30 is disposed, and further, within the insulation gas container 37, insulation gas 1 such as SF6 gas is filled so that the dielectric resistance along the outer surface of the vacuum tube 30 is improved.

The vacuum tube 30 is constituted in the following manner, in that above a metal casing 8 an insulator bushing 6A of ceramic material is provided, and further a stationary conductor 2 is fixed via a seal metal fitting 7A provided above the insulator bushing 6A. Of course, the inside of the metal casing 8 is sealed in vacuum tight.

Below the metal casing 8 an insulator bushing 6C is provided, and further, a grounding conductor 9 is held by a seal metal fitting 7C via a bellows 10C. A movable conductor 3 which is disposed in a perpendicular direction with respect to the stationary conductor 2 extends outside the vacuum tube 30 and is held by a bellows 10B and a seal metal fitting 7B. Similarly, at the side of the metal casing 8 another insulator bushing 6B of ceramic material is provided.

Figure 2:
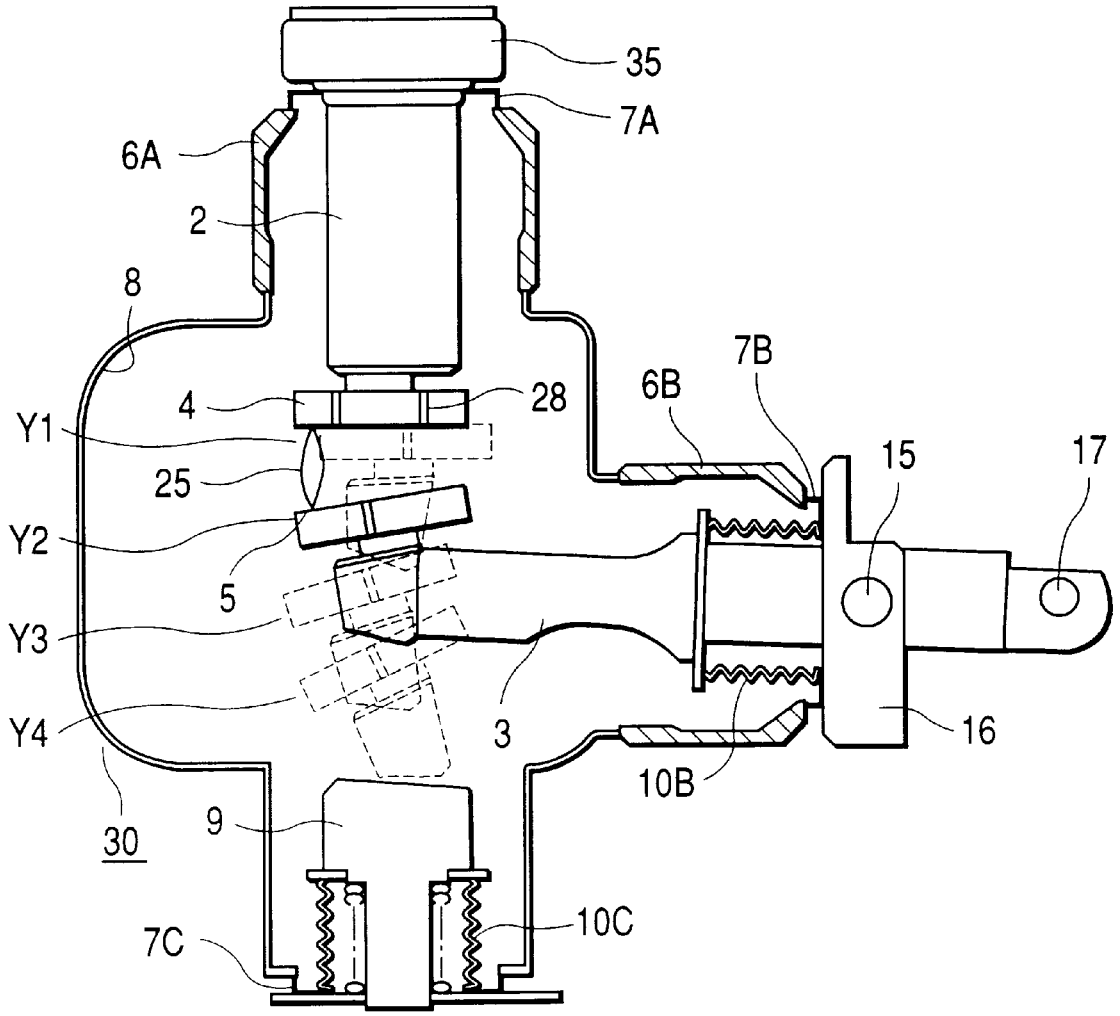
FIG. 2 is a vertical side cross sectional view showing another embodiment of an insulated type switchgear device according to the present invention.
Figure 3:
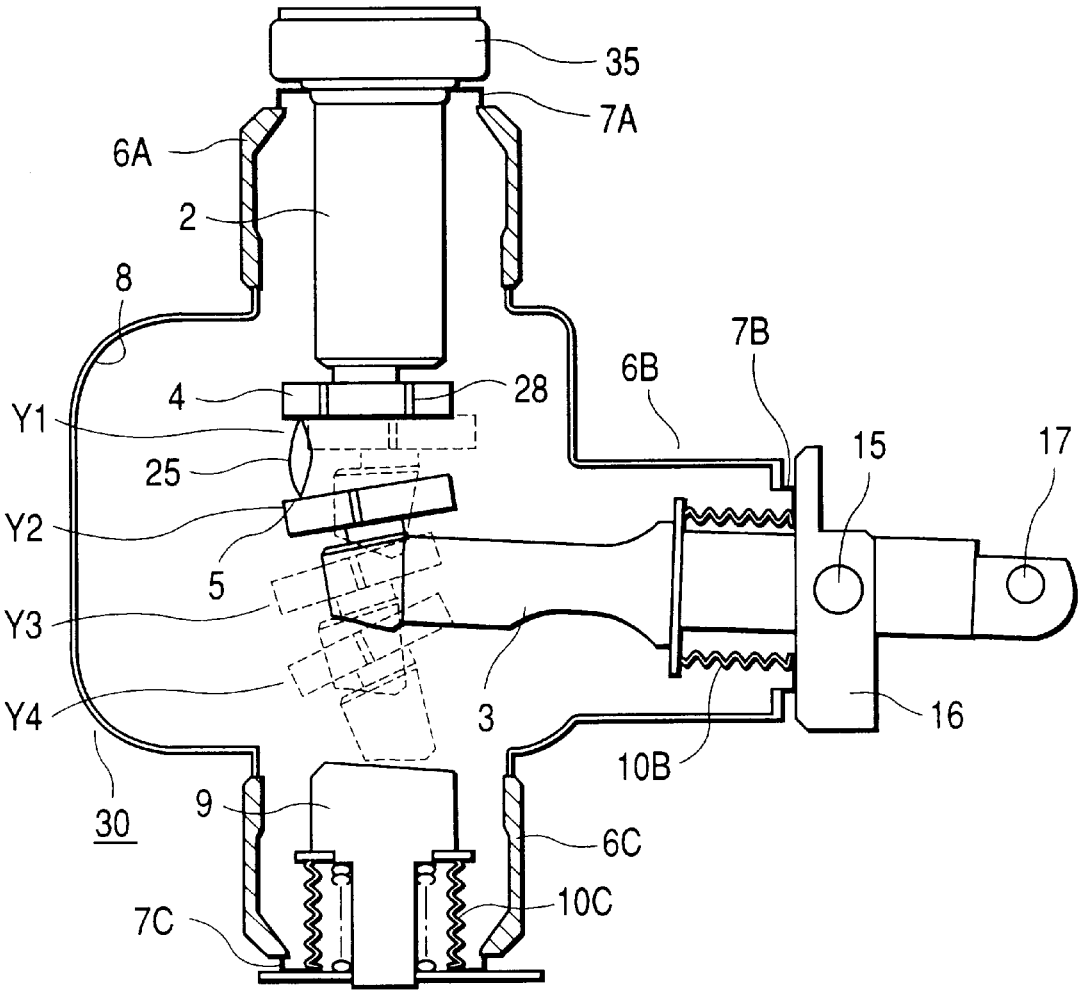
FIG. 3 is a vertical side cross sectional view showing still another embodiment of an insulated type switchgear device according to the present invention.

Further, in the present embodiment, three insulator bushings 6A, 6B and 6C are provided; however, it is unnecessary to provide all of the three insulator bushings, in that it is sufficient if at least two insulator bushings are provided as in the embodiments 2 and 3 as illustrated in FIGS. 2 and 3.

The stationary conductor 2 is connected to an interconnecting conductor 35 at the outside of the vacuum tube 30 and the interconnecting conductor 35 is secured to the insulation gas container 37. A bus side conductor 36A which is connected to a side portion of the interconnecting conductor 35 is connected to a bus 36B disposed in a bus insulator plate 36. Further, the bus side conductor 36A and the bus 36B are formed integrally with the bus insulator plate 36 by injection molding of epoxy resin.

At the tops of the stationary conductor 2 and the movable conductor 3, a stationary arc electrode 4 and a movable arc electrode 5 made of a material having a high melting point, such as Cu—Pb alloy, are respectively provided.

Further an arc 25 is concentratedly ignited at a certain spot between the arc electrodes 4 and 5 as indicated above, the surface temperature of the arc electrodes 4 and 5 rises to cause melting of the arc electrode metal; therefore, it is necessary to provide a driving force for the arc 25 to always move between the arc electrodes 4 and 5. For this purpose, in the present embodiment spiral electrodes are used for the arc electrodes 4 and 5. Namely, spiral ditches 28 are respectively provided for the arc electrodes 4 and 5, and, by means of a current flowing through the arc electrodes 4 and 5, the arc 25 is applied of a magnetic force directing in the circumference of the arc electrodes 4 and 5.

The movable conductor 3 is designed to rotate around a main axis 15 provided at a connecting conductor 16. The movable conductor 3 is sandwiched by the connecting conductor 16 which is connected to a load side conductor 38 and is held by the main axis 15 which is inserted into respective through holes provided at the connecting conductor 16 and the movable conductor 3. The movable conductor 3 is coupled at an end portion 17 thereof to an operating mechanism portion 40 via an insulator rod 39.

The movable conductor 3 is designed to be rotated via an operating device (not shown) around the main axis 15 in the (illustrated) vertical direction and to be stopped at the following four positions: a circuit making position Y1 in which the movable arc electrode 5 is in contact with the stationary arc electrode 4; a circuit breaking position Y2 in which the movable arc electrode 5 is rotated downward from the circuit making position Y1 to interrupt a current flowing through the pair of arc electrodes 4 and 5; a disconnecting position Y3 in which the movable arc electrode 5 is further rotated downward to keep a dielectric distance which can withstand a high voltage caused by lightening for example; and a grounding position Y4 in which the movable arc electrode 5 is further rotated downward to contact with the grounding conductor 9.

Figure 4:
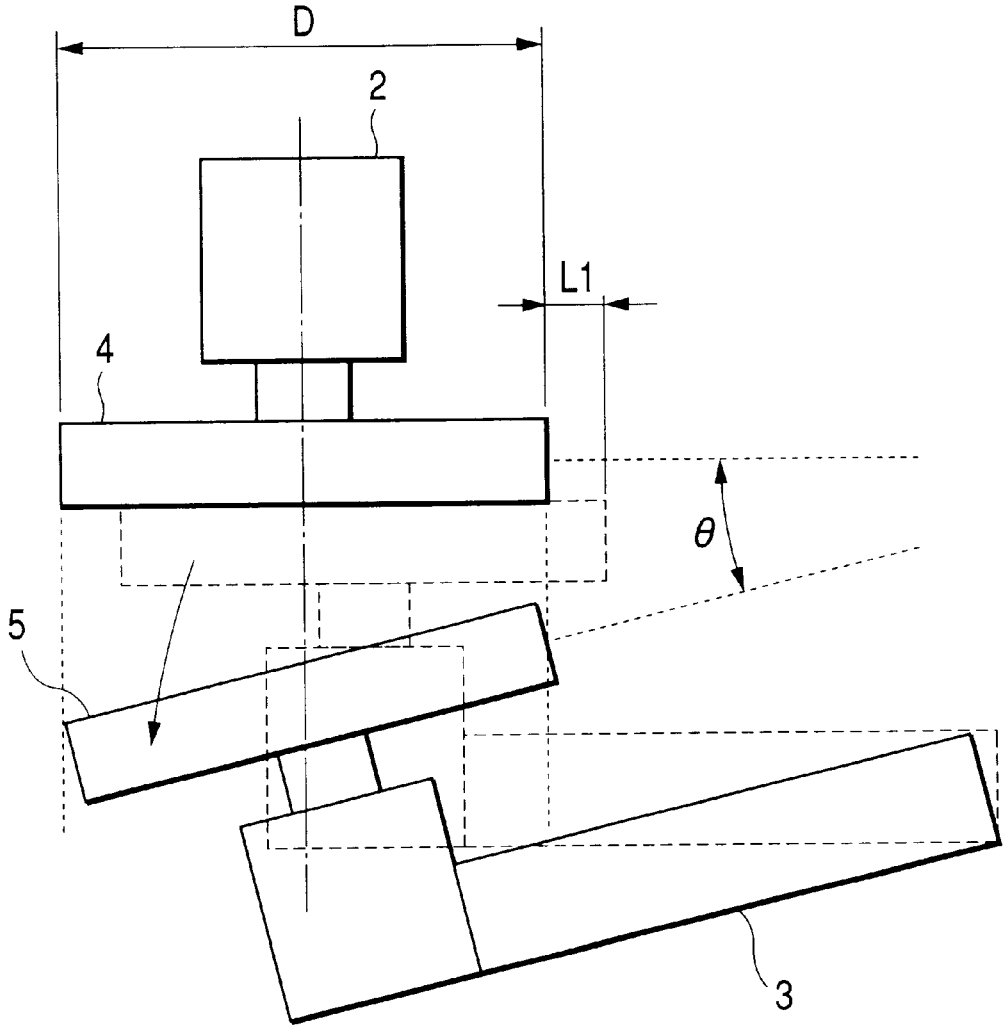
FIG. 4 is a diagram showing a relationship between an offsetting of arc electrodes at a circuit making position of a insulated type switchgear device according to the present invention and an angle formed by the arc electrodes at a circuit breaking position thereof.

Now, correlations of the position and direction of the movable arc electrode 5 at the circuit breaking position Y2 with a variety of performances of the device are explained. A possible offsetting between arc electrodes 4 and 5 at the circuit breaking position Y2 reduces an arc igniting area (effective electrode area). Accordingly, in order to improve the circuit breaking performance it is preferable to locate the center of the movable arc electrode 5 at the circuit breaking position Y2 near the center axis of the stationary arc electrode 4 as much as possible as illustrated in FIG. 4. For this purpose, the arc electrodes 4 and 5 are disposed in an offset manner with respect to each other at the circuit making position thereof.

Figure 5:
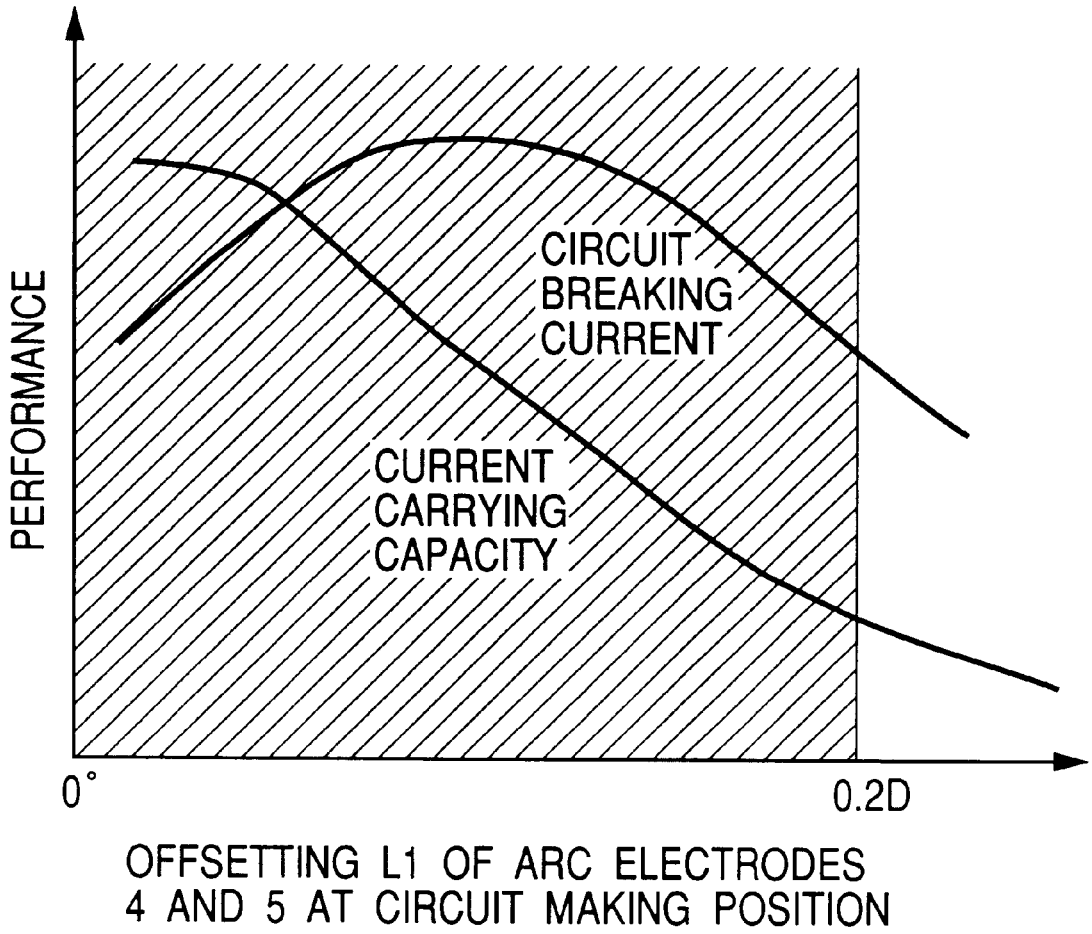
FIG. 5 is a characteristic diagram showing a relationship between an offsetting of arc electrodes at the circuit making position of a insulated type switchgear device according to the present invention, and the circuit breaking performance and current carrying capacity thereof.

However, when the arc electrodes 4 and 5 are disposed in an offset manner, the current carrying performance thereof is reduced because of the decrease of their contacting area. FIG. 5 shows relationships between an offsetting L1 between the arc electrodes 4 and 5 when at the circuit making position, and the circuit breaking performance and current carrying capacity of the arc electrodes 4 and 5. In the graphs shown in FIG. 5, the abscissa indicates the offsetting L1 normalized by the diameter of the arc electrodes 4 and 5. In view of the characteristics represented by the graphs it is understood that the offsetting L1 is preferable at least less than 20% of the diameter D of the arc electrodes 4 and 5 as indicated by a hatched region.

Figure 6:
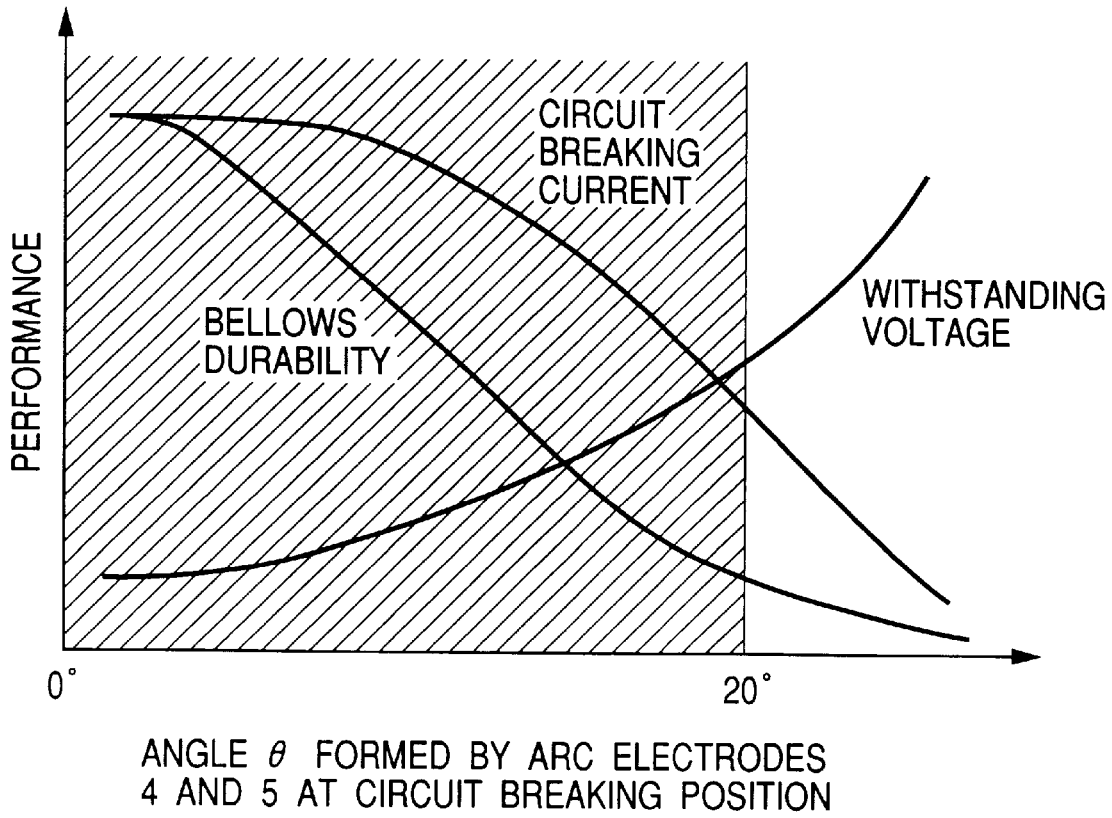
FIG. 6 is a characteristic diagram showing a relationship between an angle formed by the arc electrodes at the circuit breaking position, and the circuit breaking performance, withstanding voltage and durability of bellows.

FIG. 6 shows relationships between an angle θ formed by the arc electrodes 4 and 5 at the circuit breaking position Y2 and circuit breaking performance thereof, the withstanding voltage between the arc electrodes 4 and 5, and the durability of the bellows 10. As shown in FIG. 6, the durability of the bellows 10 decreases with an increase of the angle θ; however, the withstanding voltage between the arc electrodes 4 and 5 increases because of increasing of the distance between the arc electrodes 4 and 5.

Further, the arc 25 tends to move toward a portion where the arc length reduces to decrease arc resistance; therefore, when the angle θ increases, an effective area, in other words a region where the arc 25 can pass through, decreases, and thereby the circuit breaking performance of the arc electrodes 4 and 5 decreases. In view of the above characteristics it is optimum to select the angle θ formed by the arc electrodes 4 and 5 at the circuit breaking position Y2 below 10°, and preferable to select the angle θ to be below 20° as indicated by a hatched region.

Now, advantages of the embodiments 1, 2 and 3 are explained. Since the movable conductor 3 is structured to be rotated around the main axis 15, a long stroke of the movable arc electrode 5 can be realized without imposing an undue burden on the bellows 10, and as a result, a long dielectric distance can be obtained; whereby the device according to the present embodiments can be used not only as circuit breakers but also as disconnecting switches.

Further, in the present embodiments three functions including a circuit breaker, a disconnecting switch and a grounding switch are accommodated in a single vacuum tube, whereby the entire size of the switchgear device is extremely reduced.

Further, as explained above, through the control of the angle θ formed by the arc electrodes 4 and 5 at the circuit breaking position Y2, as well as through optimizing the relative position of the arc electrodes 4 and 5 at the circuit breaking position Y2 by disposing the arc electrodes 4 and 5 in an offset manner at the circuit making position Y1, a variety of performances such as circuit breaking, withstanding voltage and current carrying of the arc electrodes 4 and 5 are improved.

Further, other than the above explanation, the present insulated type switchgear devices according to the present embodiments can be used as a single function switchgear such as a circuit breaker in which the movable arc electrode 5 is engaged and disengaged with the stationary arc electrode 4, a disconnecting switch in which the movable conductor 3 is moved from the stationary conductor 2 up to the disconnecting position Y3, and a grounding switch in which the movable conductor 3 and the grounding conductor 9 are used.

Still further, the structure of the present insulated type switchgear device can also be employed without being disposed in the vacuum tube 30 or the insulation gas container 37.

Now, an embodiment 4 according to the present invention is explained. In the embodiment 1, since the stationary conductor 2 and the movable conductor 3 are arranged in an L shape, an electromagnetic force acts on the arc 25 which causes the arc 25 to be driven out toward the outside of the L shape (to the left in FIG. 1). Accordingly, the arc 25 cannot be held between the arc electrodes 4 and 5 which possibly reduces the circuit breaking performance of the arc electrodes 4 and 5. The embodiment 4 is devised for the purpose of reducing the above mentioned electromagnetic force.

Figure 7:
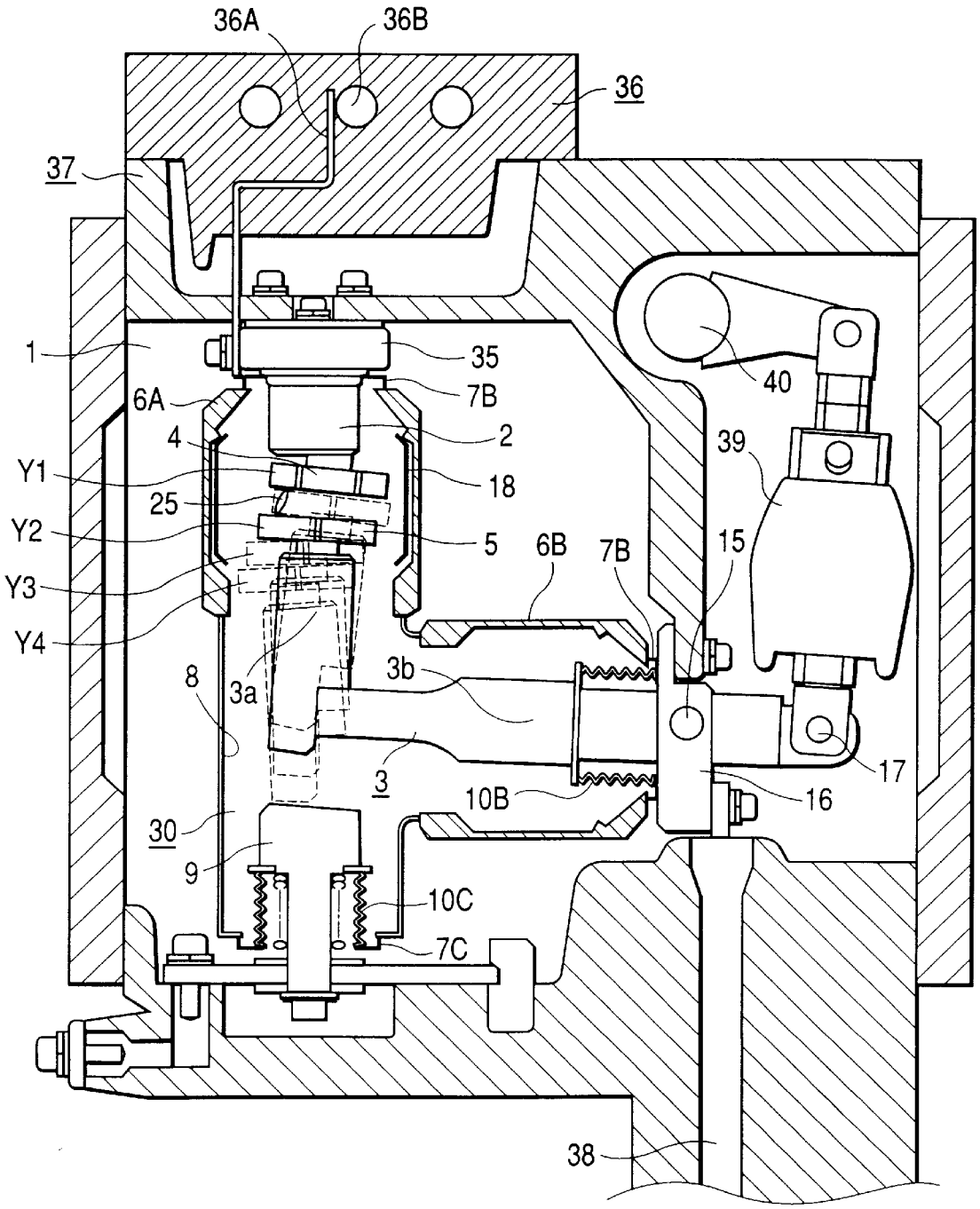
FIG. 7 is a vertical side cross sectional view showing a further embodiment of an insulated type switchgear device according to the present invention.

FIG. 7 shows a side cross sectional view of the embodiment 4. The movable conductor 3 is an L shaped conductor. The L shaped movable conductor 3 can be produced from an integral body; otherwise, as illustrated in FIG. 7, the L shaped movable conductor 3 can be formed by, for example, soldering two pieces of straight line conductors 3*a* and 3*b*. Further, in the present embodiment, since the arc electrodes 4 and 5 are designed to be disposed inside the insulator bushing 6A, an arc vapour shield 18 is provided around the arc electrodes 4 and 5 which is for preventing vapour metal particles from depositing on the inner wall of the insulator bushing 6A and from reducing the insulating property thereof. Still further, the arc electrodes 4 and 5 can be disposed in the metal casing 8 as in the embodiment 1 so as to eliminate the arc vapour shield 18.

Figure 8:
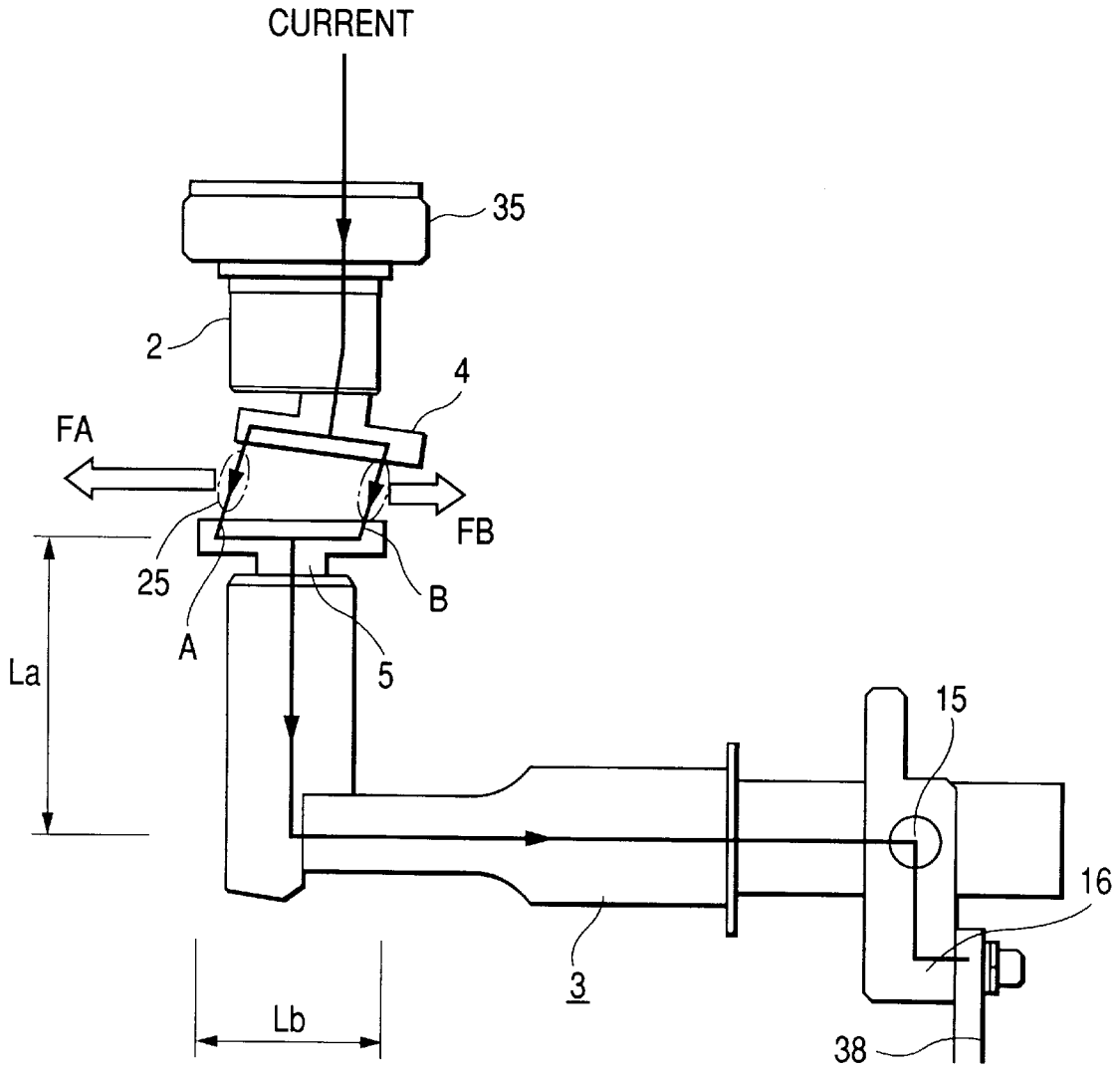
FIG. 8 is a schematic diagram showing current flowing passages and electromagnetic forces acting on arcs in an insulated type switchgear device according to the present invention.

At first, the electromagnetic force acting on the arc 25 is explained. As illustrated in FIG. 8, a current flowing through the movable conductor 3 causes an electromagnetic force on the arc 25 directed to leftward in the drawing based on Fleming's rule and reduces a driving force acting on the arc 25 so as to move rightward. Still further, the arc 25 can be driven out from the arc electrodes 4 and 5 at a position A or can be confined inside the arc electrodes 4 and 5 at a position B because of a weak rotating force acting thereon. Accordingly, it is necessary to suppress an influence of the current flowing through the movable conductor 3 as much as possible.

Electro-magnetic forces FA and FB acting on arc 25 at the positions A and B depend on a distance La from the movable arc electrode 5 to a bent portion of the movable conductor 3.

Figure 9:
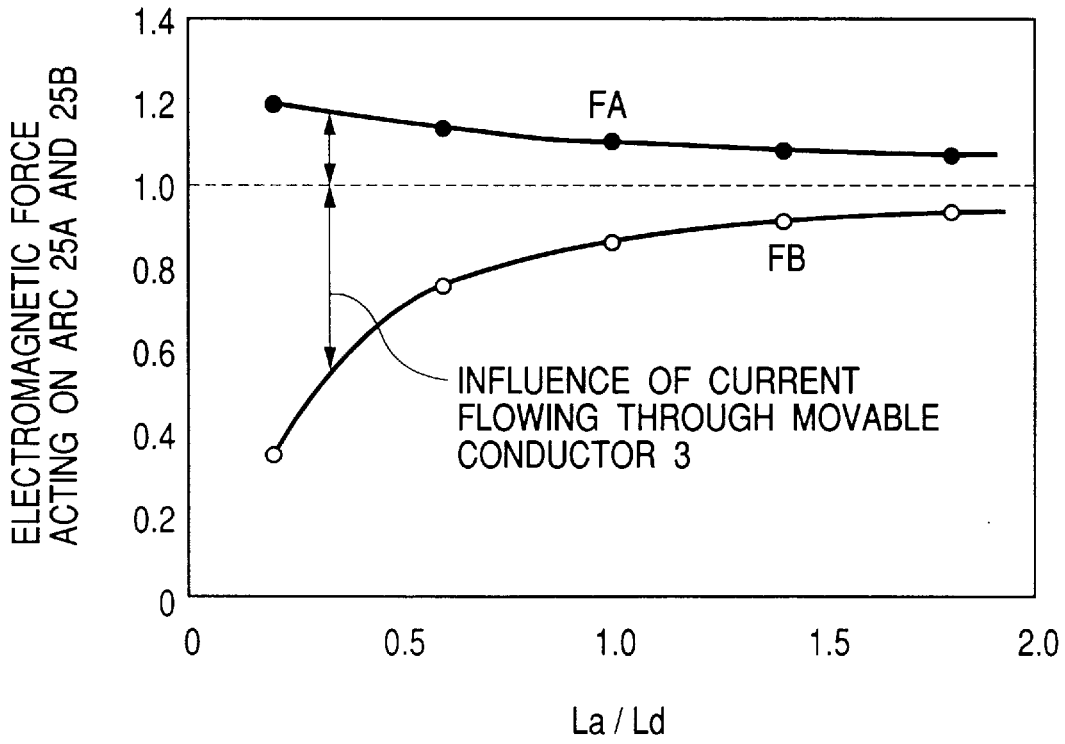
FIG. 9 is a characteristic diagram showing a relationship between a distance from the movable arc electrode to a bent portion of the movable conductor in an insulated type switchgear device according to the present invention.
Figure 10:
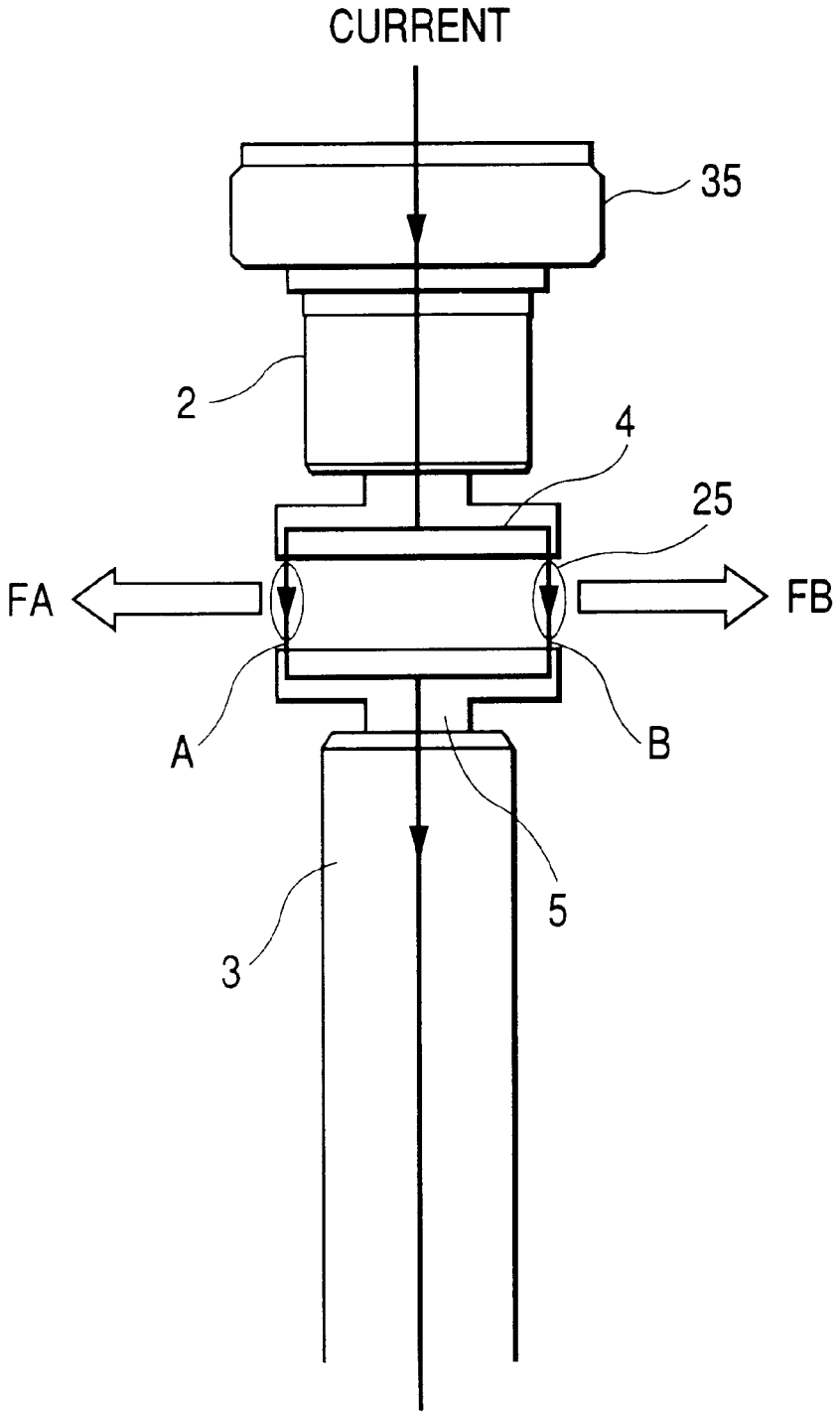
FIG. 10 is a schematic diagram showing current flowing passages and electromagnetic forces acting on arcs in a conventional type electrode arrangement.

FIG. 9 shows such dependency. In the graphs shown in FIG. 9, the abscissa indicates the distance La normalized by the diameter Ld of the arc electrodes 4 and 5 and, further, the ordinate indicates the electromagnetic force acting on the arc 25 normalized by an electromagnetic force induced by a conventional electrode arrangement shown in FIG. 10.

In view of the characteristics shown in FIG. 9, the current flowing through the movable conductor 3 exerts a large electromagnetic force, in particular, to the arc 25 at the position B; however, depending on an increase of La the influence thereof is relaxed. In order to effectively hold the arc 25 between the arc electrodes 4 and 5 while permitting a rotational movement thereof, it is preferable to set the distance La larger than the diameter Ld of the arc electrodes 4 and 5, and it is necessary to set the distance La at least more than 30% of the diameter Ld of the arc electrodes 4 and 5.

Finally, the advantages of the embodiment 4 are explained. In addition to the advantages obtained by the previous embodiments 1 through 3, the present embodiment 4 has the following advantages. Namely, through the setting of the distance La from the movable arc electrode 5 to the bent portion of the L shaped movable conductor 3 more than 30% of the diameter Ld of the arc electrodes 4 and 5, the influence of the current flowing through the movable conductor 3 affected on the arc 25 can be reduced. Accordingly, the behavior of the arc 25 is solely determined by the current flowing through the arc electrodes 4 and 5. Namely, the arc 25 behaves in like manner as that in a conventional vacuum circuit breaker in which arc electrodes are moved in their axial direction, whereby the structure of the present embodiment can be applied to the conventional electrode structure.

According to the present invention as explained above, since the arc electrodes at the circuit making position is arranged in an offset manner, a possible offsetting of the arc electrodes at the circuit breaking position thereof is reduced, and accordingly, the circuit breaking performance of the arc electrodes is improved due to the advance offsetting, whereby the size of this sort of insulated type switchgear devices is reduced.

We claim:

1. An insulated type switchgear device, comprising:

a vacuum tube enclosing a stationary arc electrode and a movable arc electrode that are separably disposed in an opposing manner, a stationary conductor connected to and extending from a back face of the stationary arc electrode, said stationary arc electrode having a center axis; and a movable conductor connected to and extending from a back face of the movable arc electrode to outside the vacuum tube, said stationary and movable arc electrodes being at their circuit making position when in physical contact with each other, and said stationary and movable arc electrodes being separable through a rotation of the movable conductor around a predetermined axis;

wherein when said movable arc electrode is brought into its circuit breaking position at which current flow between said stationary and movable arc electrodes is interrupted, an electrode center of said movable arc electrode is located near or at said center axis of said stationary arc electrode.

2. An insulated type switchgear device according to claim 1, wherein the center axis of said movable arc electrode is offset from the center axis of the stationary arc electrode when said stationary and movable arc electrodes are in their circuit making position.

3. An insulated type switchgear device according to claim 2, wherein the offsetting of the electrode center of said movable arc electrode from the center axis of said stationary arc electrode is less than 20% of a diameter of said movable arc electrode.

4. An insulated type switchgear device, comprising:

a vacuum tube enclosing a stationary arc electrode and a movable arc electrode that are separably disposed in an opposing manner, and a movable conductor connected to and extending from a back face of the movable arc electrode to outside the vacuum tube, said stationary and movable arc electrodes being separable through a rotation of the movable conductor around a predetermined axis;

wherein an angle (θ) formed by the facing surfaces of said stationary and movable arc electrodes when said movable arc electrode is in its circuit breaking position, at which current flow between said stationary and movable electrodes is interrupted, is greater than 0° and less than 20°.

5. An insulated type switchgear device according to claim 1, wherein said movable conductor is configured in an L shape, and a distance (La) from said movable arc electrode to a bent portion of said L-shaped movable conductor is longer than 30% of a diameter of said movable arc electrode.

6. An insulated type switchgear device according to claim 1, further comprising a grounding conductor disposed in said vacuum tube, wherein at least one of opening and closing between said stationary and movable arc electrodes and between said movable conductor and said grounding conductor is effected through rotation of said movable conductor.

7. An insulated type switchgear device according to claim 2, further comprising a grounding conductor disposed in said vacuum tube, wherein at least one of opening and closing between said stationary and movable arc electrodes and between said movable conductor and said grounding conductor is effected through rotation of said movable conductor.

8. An insulated type switchgear device according to claim 3, further comprising a grounding conductor disposed in said vacuum tube, wherein at least one of opening and closing between said stationary and movable arc electrodes and between said movable conductor and said grounding conductor is effected through rotation of said movable conductor.

9. An insulated type switchgear device according to claim 4, further comprising a grounding conductor disposed in said vacuum tube, wherein at least one of opening and closing between said stationary and movable arc electrodes and between said movable conductor and said grounding conductor is effected through rotation of said movable conductor.

10. An insulated type switchgear device according to claim 5, further comprising a grounding conductor disposed in said vacuum tube, wherein at least one of opening and closing between said stationary and movable arc electrodes and between said movable conductor and said grounding conductor is effected through rotation of said movable conductor.

11. An insulated type switchgear device according to claim 1, wherein said stationary and movable arc electrodes are respectively provided with a ditch for magnetically driving an arc generated therebetween.

12. An insulated type switchgear device according to claim 2, wherein said stationary and movable arc electrodes are respectively provided with a ditch for magnetically driving an arc generated therebetween.

13. An insulated type switchgear device according to claim 3, wherein said stationary and movable arc electrodes are respectively provided with a ditch for magnetically driving an arc generated therebetween.

14. An insulated type switchgear device according to claim 4, wherein said stationary and movable arc electrodes are respectively provided with a ditch for magnetically driving an arc generated therebetween.

15. An insulated type switchgear device according to claim 5, wherein said stationary and movable arc electrodes are respectively provided with a ditch for magnetically driving an arc generated therebetween.

16. An insulated type switchgear device according to claim 6, wherein said stationary and movable arc electrodes are respectively provided with a ditch for magnetically driving an arc generated therebetween.

17. An insulated type switchgear device according to claim 7, wherein said stationary and movable arc electrodes are respectively provided with a ditch for magnetically driving an arc generated therebetween.

18. An insulated type switchgear device according to claim 8, wherein said stationary and movable arc electrodes are respectively provided with a ditch for magnetically driving an arc generated therebetween.

19. An insulated type switchgear device according to claim 9, wherein said stationary and movable arc electrodes are respectively provided with a ditch for magnetically driving an arc generated therebetween.

20. An insulated type switchgear device according to claim 10, wherein said stationary and movable arc electrodes are respectively provided with a ditch for magnetically driving an arc generated therebetween.

21. An insulated type switchgear device as claimed in claim 1, wherein an angle (θ) formed by the facing surfaces of said stationary and movable arc electrodes when said movable arc electrode is in its circuit breaking position is greater than 0° and less than 20°.

22. An insulated type switchgear device, comprising:

a vacuum tube enclosing a stationary and a movable arc electrode that are separably disposed in an opposing manner; and a movable conductor connected to and extending from a back face of the movable arc electrode to outside the vacuum tube, said stationary and movable arc electrodes being separable through a rotation of the movable conductor around a predetermined axis;

wherein when said movable arc electrode is brought into its circuit breaking position at which current flow between said stationary and movable arc electrodes is interrupted, a line passing perpendicularly through a center of a front face of said stationary arc electrode also passes through a center point of a front face of said movable arc electrode.

23. An insulated type switchgear device as claimed in claim 22, wherein the center axis of said movable arc electrode is offset from the center axis of the stationary arc electrode when said stationary and movable arc electrodes are in their circuit making position.

24. An insulated type switchgear device according to claim 23, wherein the offsetting of the electrode center of said movable arc electrode from the center axis of said stationary arc electrode is less than 20% of a diameter of said movable arc electrode.

25. An insulated type switchgear device according to claim 22, further comprising a grounding conductor disposed in said vacuum tube, wherein at least one of opening and closing between said stationary and movable arc electrodes and between said movable conductor and said grounding conductor is effected through rotation of said movable conductor.

26. An insulated type switchgear device according to claim 23, further comprising a grounding conductor disposed in said vacuum tube, wherein at least one of opening and closing between said stationary and movable arc electrodes and between said movable conductor and said grounding conductor is effected through rotation of said movable conductor.

27. An insulated type switchgear device according to claim 24, further comprising a grounding conductor disposed in said vacuum tube, wherein at least one of opening and closing between said stationary and movable arc electrodes and between said movable conductor and said grounding conductor is effected through rotation of said movable conductor.

28. An insulated type switchgear device as claimed in claim 22, wherein an angle (θ) formed by the facing surfaces of said stationary and movable arc electrodes when said movable arc electrode is in its circuit breaking position is greater than 0° and less than 20°.

* * * * *